US008522993B2

(12) United States Patent
Flewelling

(10) Patent No.: US 8,522,993 B2
(45) Date of Patent: Sep. 3, 2013

(54) ADVANCED HOUSEHOLD WASTE AND RECYCLING DEVICE AND METHOD

(76) Inventor: Neal Warren Flewelling, Toronto (CA)

( * ) Notice: Subject to any disclaimer, the term of this patent is extended or adjusted under 35 U.S.C. 154(b) by 0 days.

(21) Appl. No.: 12/923,694

(22) Filed: Oct. 5, 2010

(65) Prior Publication Data

US 2011/0089179 A1 Apr. 21, 2011

Related U.S. Application Data

(60) Provisional application No. 61/278,149, filed on Oct. 5, 2009.

(51) Int. Cl.
*B65D 43/26* (2006.01)

(52) U.S. Cl.
USPC ..... 220/263; 220/909; 220/524; 220/255

(58) Field of Classification Search
USPC ..... 220/524, 23.83, 23.96, 23.88, 262, 220/263, 264, 909, 255, 254.2, 254.3, 254.6, 220/259.1, 259.2, 259.5, 254.1, 254.4, 254.5, 220/256.1
See application file for complete search history.

(56) References Cited

U.S. PATENT DOCUMENTS

| | | | | |
|---|---|---|---|---|
| 1,065,734 | A | 6/1913 | Schwartz | |
| 1,580,880 | A | 4/1926 | Frisble | |
| 1,763,907 | A * | 6/1930 | Sommers | 220/255 |
| 2,251,043 | A | 7/1941 | Freedman | |
| 2,667,320 | A | 1/1954 | Whitley | |
| 2,736,454 | A | 2/1956 | Mcconnell et al. | |
| 3,028,015 | A | 4/1962 | Williams et al. | |
| 3,378,323 | A | 4/1968 | Goldberg et al. | |
| RE30,875 | E | 3/1982 | Anderson | |
| 4,892,218 | A | 1/1990 | Reiling | |
| 5,048,712 | A | 9/1991 | Wolters | |
| 5,082,132 | A * | 1/1992 | Tsai | 220/23.83 |
| 5,088,616 | A * | 2/1992 | Susko et al. | 220/909 |
| 5,331,348 | A | 7/1994 | Knauer et al. | |
| 5,348,222 | A | 9/1994 | Patey | |
| 6,039,200 | A | 3/2000 | Armor | |
| 6,209,744 | B1 * | 4/2001 | Gill | 220/263 |
| 6,719,194 | B2 * | 4/2004 | Richards | 220/263 |
| 6,942,117 | B2 * | 9/2005 | Foltz | 220/259.1 |
| 7,530,578 | B2 * | 5/2009 | Niemeyer et al. | 220/263 |
| 7,607,552 | B2 * | 10/2009 | Efstathiou | 220/264 |
| 7,984,822 | B2 * | 7/2011 | Watson et al. | 220/254.6 |
| 2003/0183633 | A1 * | 10/2003 | Pope | 220/263 |
| 2007/0068942 | A1 * | 3/2007 | Smudde | 220/23.86 |
| 2009/0250463 | A1 | 10/2009 | Van Risseghem et al. | |

* cited by examiner

*Primary Examiner* — Andrew Perreault

(57) ABSTRACT

A container lid opener and storage device providing storage for a plurality of wheeled containers that have hinged lids. The containers used for separating different types of household waste are pushed into the device where each container lid is coupled to a single outer lid. The connecting tether assembly provides access for attaching and detaching the container lids when the single outer lid is in a closed position. The tethers are semi flexible providing sufficient slack for attaching a dethatching in addition to a maximum container lid open angle relevant to the respective outer lid open angle positioning. A single foot pedal is used to simultaneously open and close multiple containers while having the use of both hands for depositing sorted items.

2 Claims, 5 Drawing Sheets

ADVANCED HOUSEHOLD WASTE AND RECYCLING DEVICE AND METHOD

PRIORITY

This application is a non-provisional of, and claims priority to and the benefit of, U.S. Provisional Patent Application No. 61/278,149, filed Oct. 5, 2009, the entire contents of which are incorporated herein by reference.

BACKGROUND

An increasing number of municipalities in North America and around the world are requiring that citizens sort their garbage and recyclable material and deposit this material in municipally mandated, individually wheeled and hinge lidded containers. A growing number of cities are requiring that citizens also sort and separately dispose food waste and other compost. These waste sorting and disposal requirements stem from the concern about growing landfill waste, it being policy in many cities to reduce landfill waste by recycling food waste and other compost material, as well as plastics, newspapers, and a variety of other goods.

From job creation, to reduction of methane emissions from landfills, to reduction in greenhouse gas emissions, to reduction in energy consumption, the benefits of recycling are indisputable.

Notwithstanding these benefits, and despite municipal bylaws and municipal provision of separate containers for garbage, compost and recyclables, many citizens are still not sorting their waste pursuant to municipal regulations. In Toronto, for example, only 15% of residents of multi-family residential buildings sort and recycle (source: City of Toronto, 2008). According to the U.S. Environmental Protection Agency, the recycling rate in the United States is 34% (2010). This means that 54% of all of waste in the United States still ends up in landfill. Much more needs to be done.

The purpose of this invention is to remove some of the obstacles to recycling, thereby encouraging and increasing recycling and food composting and enhancing the environment.

Presently, most trash, compost and recycling containers are stored outdoors, exposed to the elements and the animals. Animals such as raccoons frequently tip over the compost containers and empty the contents in their search for food. This leaves a mess, and potentially harmful bacteria on the containers.

Also presently, when a citizen wishes to dispose of various waste, he takes this waste outside, sometimes in appropriate bags and sometimes not. He then must put the waste on the ground or in one hand, and individually open one of the various garbage, compost or recycling containers to make a deposit. This step must be repeated over and over for each container. In addition, this requires hand contact with the container lids. In the case of the compost containers, this inconvenience is exacerbated by the fact that containers often have bungee cords and other devices keeping them closed, in order to ward off raccoons. These devices must be detached. This hand contact can also be potentially dangerous, as compost containers are often contaminated with germs and bacteria.

Some of the reasons why some people refuse to comply with municipal waste regulations (85% of residents of multi-family apartments in Toronto), include the fact that it is more time-consuming to sort waste than it is to put it all in one bag or bin. In addition, over time, containers (particularly compost containers) become encrusted in food waste and contaminated with germs. Some citizens refuse to touch these containers, as they do not wish to be exposed to these germs. Citizens also fear contact with compost containers because of raccoons: raccoons have become adept at opening compost containers to get at the food, not only creating a mess for citizens but also potentially leaving behind infectious and potentially fatal disease. Raccoons carry Rabies, Roundworm, Giardiasis, Leptospirosis and other diseases such as *Salmonella* and *E. Coli*. (Rhode Island Department of Environmental Management).

SUMMARY

With the single, foot pedal operated lid device of the present invention, citizens will take their garbage, food waste and recyclables to an outside housing enclosure which will house a variety of municipally mandated, outdoor, individually wheeled and hinge lidded trash, compost and recycling containers set inside the enclosure. A single outer lid will be pivotally affixed to the back of the storage enclosure. With one depression of the foot pedal the single outer lid will open, simultaneously opening the lids of all of the waste and recycling containers inside the housing enclosure due to the fact that the lids of these containers will be tethered to the underside of the single outer lid. Citizens will then drop the various wastes in the appropriate containers, simultaneously, or in a series of drops, without having to touch the container lids or the single outer lid. Once deposits are complete, citizens will release the foot pedal and the single outer lid will close, simultaneously closing the individual container lids inside.

The purpose of this foot pedal operated lid device is, ultimately, to help the environment by removing the barriers that keep people from recycling, thereby increasing compliance with municipal waste and recycling regulations. In particular, the intention is that the convenience of this hands free method of depositing waste will increase composting and recycling compliance, thereby reducing landfill waste. The present invention is also intended to solve the problem of raccoons and other foraging animals constantly getting into compost and trash containers, creating a mess and contaminating the containers.

DETAILED DESCRIPTION

Figure 1:
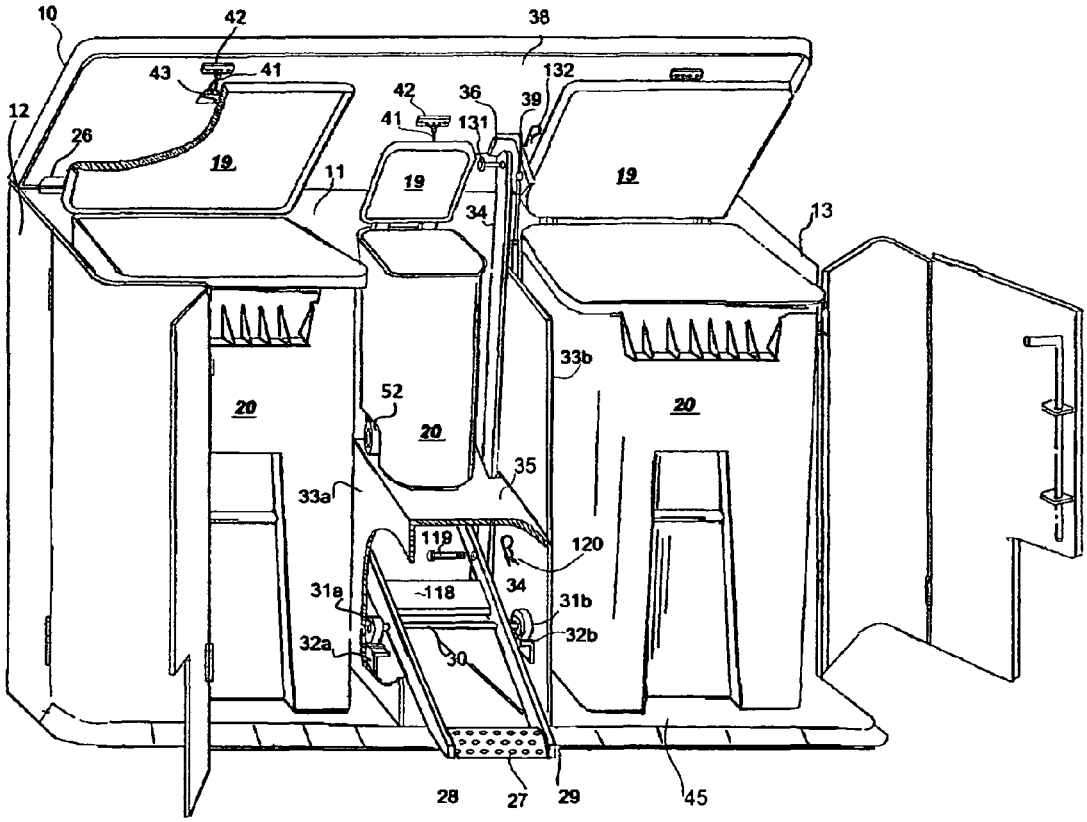
FIG. 1 is perspective view of the preferred embodiment.

Referring to FIG. 1, in the preferred embodiment of the present invention. Wheels 52 and container lid 19 of the outdoor household trash, compost and recycling containers 20 are illustrated. Housed in a housing enclosure 10. These types of housing enclosures 10 are readily available to consumers from a number of small and large manufacturers. Generally made of wood, plastic, alloy, or combination. These housing enclosures 10 typically have a base 45, a back wall 11, a left sidewall 12 and a right sidewall 13 and front wall access for placement and removal of the containers 20.

Inserted into and attached to this housing enclosure 10 is a foot pedal operated single outer lid device of the present invention.

In the preferred embodiment, the foot pedal 27 is constructed of rigid, resilient material such as metal, alloy, composite, or the like, and is generally, centrally located at the base 45 of the housing enclosure 10. The foot pedal 27 perpendicularly couples to a forwardly projecting left pedal member 28 and a forwardly projecting right pedal member 29.

The foot pedal 27 is placed approximately 12 inches (30.5 centimeters) from the ground at the top of its travel and its travel. The foot pedal treading surface swivels independent of its rotation around a shaft 30, configured to rotate within 30 degrees between the left pedal member 28 and the right pedal member 29 for ergonomic foot articulation. The top surface of the pedal 27 has traction surface for non-slip treading.

The left 28 and right 29 pedal members are made of aluminum flat bar and fixed to a horizontal shaft 30 in order to rotate. Structural reinforcement 118 is secured between the left pedal member 28 and right pedal member 29. This foot pedal assembly forms a rigid body that rotates on the shaft 30 in the form of a second-class lever. Various other configurations could be employed to apply similar principles of leverage.

What follows is a detailed description of the various linkages, and structures that are combined to urge the single outer lid 38 open using the foot pedal 27.

FIG. 1, shaft 30 is made of aluminum and is pivotally mounted with a left bi-directional bearing 31*a* and a right bi-directional bearing 31*b*. The bi-directional bearings 31*a* and 31*b* are supported by a left bracket 32*a* and a right bracket 32*b*. The brackets 32*a* and 32*b* are respectively mounted on a left pedal member wall 33*a* and a right pedal member wall 33*b* so as to orientate the pedal 27 to operate within the approximate 12-inch (30.5 centimeters) height indicated.

The left pedal member wall 33*a* and the right pedal member wall 33*b* extend from the base 45 of the housing enclosure 10, with the left pedal member wall 33*a* having a height to support a slotted platform 35. The slotted platform 35 is horizontally oriented, extending laterally from the top of left pedal member wall 33*a*, over to the side of the right pedal member wall 33*b*.

The platform 35 covers the pedal member segments 28 and 29 within their range of operation. The slotted platform 35 extends from the front of the enclosure 10 to the back wall 11. The right pedal member wall 33*b* extends upwardly, higher than the left pedal member wall 33*a* for the purpose of mounting a gas spring shock 39. The gas spring shock extends upward to an abutment bracket 36, that is affixed to the underside of the single outer lid 38.

Figure 2:
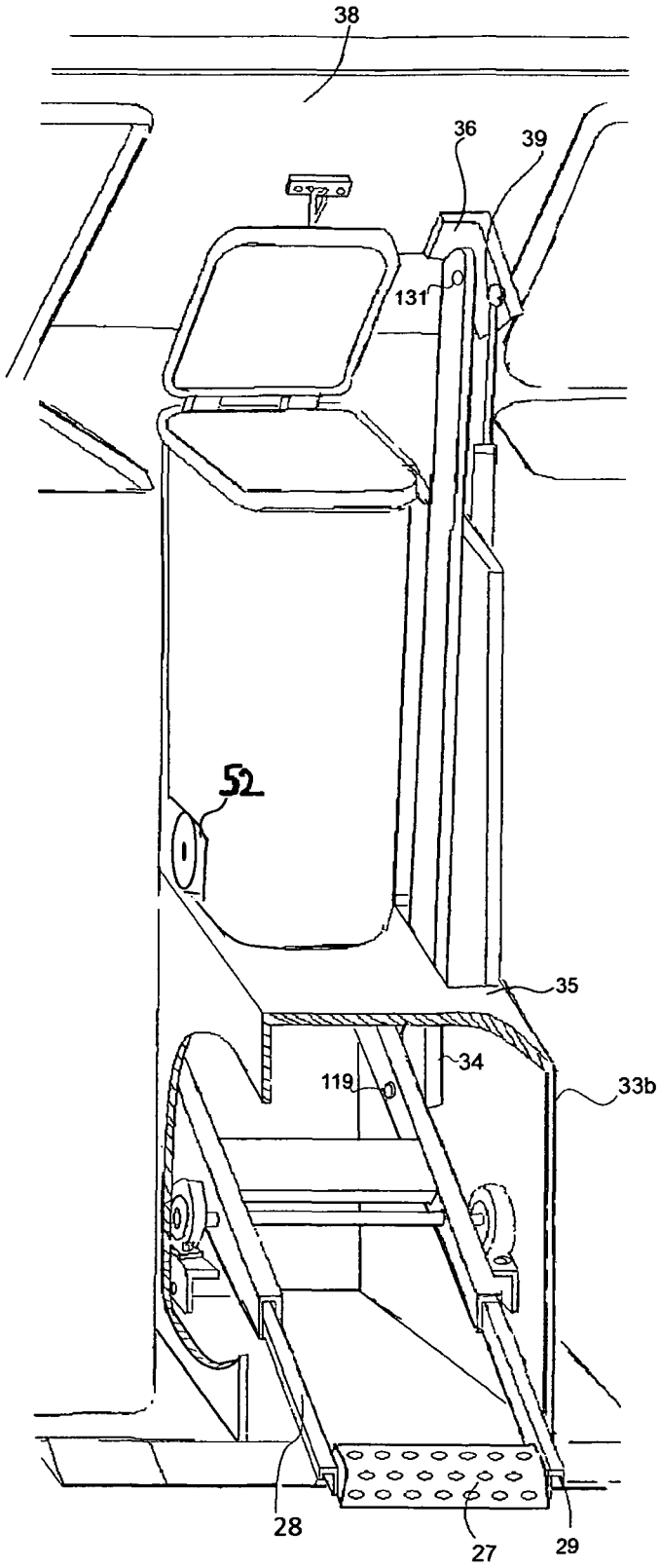
FIG. 2 is a partial view of foot pedal linkages and pedal assembly sub-housing.

Referring to FIG. 2 Gas spring shock 39 assists in urging upwards the single outer lid 38 when the foot pedal 27 is activated. The gas spring shock 39 is pivotally mounted on one end to the abutment bracket 36. The opposite end of the gas spring shock 39 is then pivotally mounted to pedal member wall 33*b*.

The top end of a vertical, elongated thrust member 34 is pivotally connected to the abutment bracket 36 using an upper clevis pin 131. The thrust member 34 is made of sufficiently rigid aluminum flat bar or equivalent. The thrust member 34 then extends downwardly, passing through the slotted platform 35 to the right pedal member 29, where it pivotally couples using a lower clevis pin 119. The thrust member 34, partially assisted by the gas spring shock 39, transmits force exerted by the actuation of the foot pedal 27, urging the single outer lid 38 to open and dampen when closing.

Referring back to FIG. 1, in the preferred embodiment the single outer lid 38 is flat and rectangular. It is sized to completely cover the top of the housing enclosure 10 and is sufficiently rigid to withstand the thrust generated by the thrust member 34.

In the preferred embodiment, the single outer lid 38 is affixed to the top of the back wall 11 of the housing enclosure 10 with a single, elongated, continuous hinge 26. It is also possible to use a series of hinges.

Figure 5:
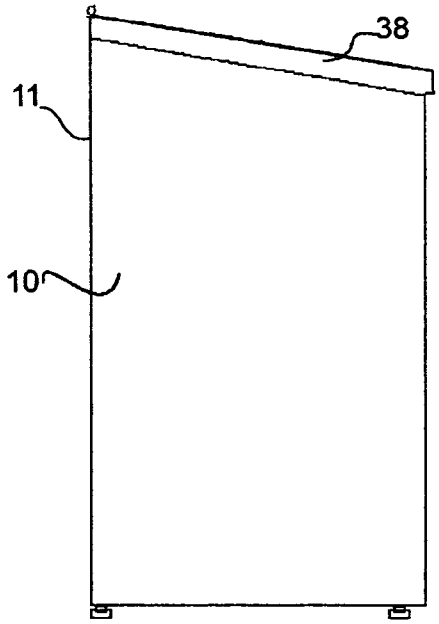
FIG. 5 is a left side elevation view showing single outer lid slope configuration.

Referring to FIG. 5, the single outer lid 38 placement is arranged to provide a downward slope from the back 11 of the housing enclosure 10 to the front of the enclosure, to allow for water run-off.

Figure 3:
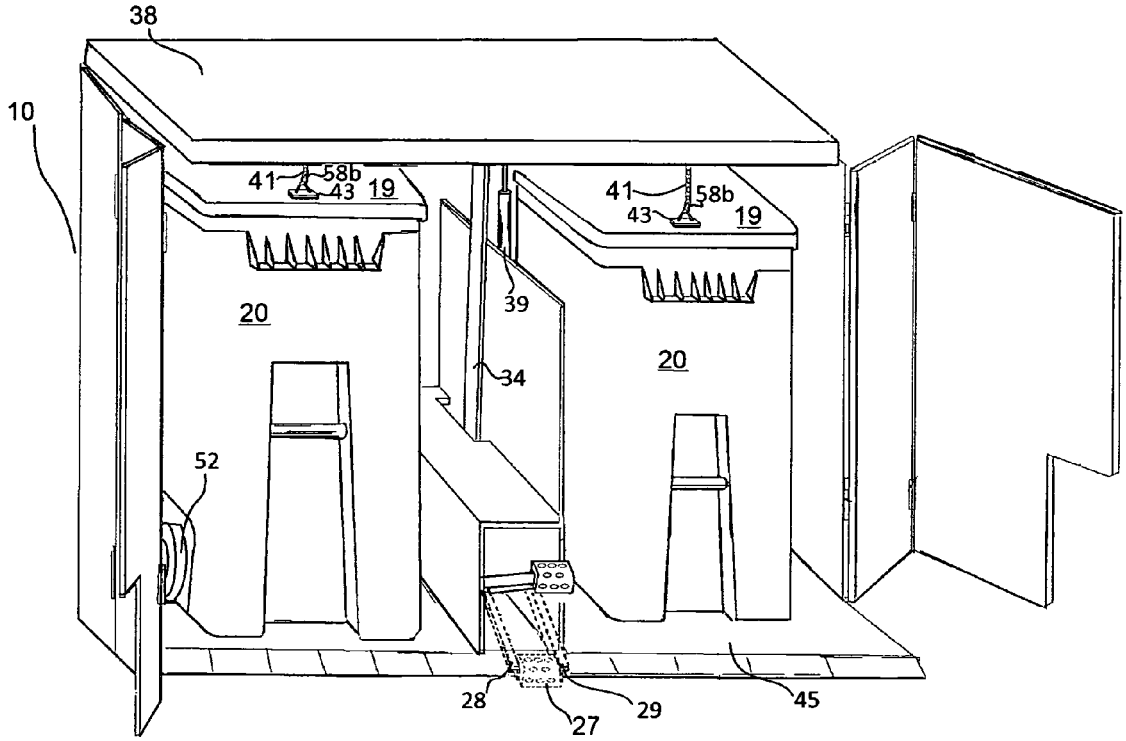
FIG. 3 is another exemplary embodiment for two, containers of differing heights.

Referring to FIG. 3, the trash, compost and recycling containers 20 inside the housing enclosure 10 can be a combination of a variety of sizes and heights. This drawing shows the single outer lid 38 in a closed position connected to container lids 19 with tethers 41. The pedal 27 travel is indicated by a ghosted line.

Figure 4:
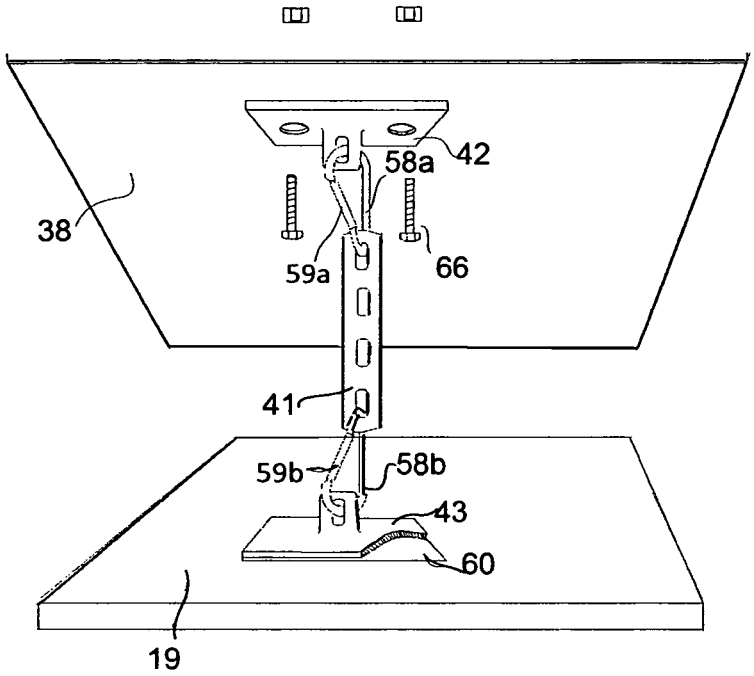
FIG. 4 is a partial and exploded view of the tether assembly coupling the single outer lid. with the individual container lid.

Referring to FIG. 4, in the preferred embodiment the container lids 19 are attached to the single outer lid 38 using adjustable settings provided by detachable tethers 41. The plurality of container lids 19 interfacing with the underside of the single outer lid 38 requires that the tethers 41 be constructed of a non-rigid, flexible or semi-flexible material, comprised of rubber or other semi-flexible or flexible material to allow for expansion and contraction. This is necessary to accommodate the lesser distance between the underside of the single outer lid 38 and the top of the containers 20 and container lids 19 when closed, and the greater distance between the underside of the single outer lid 38 and the top of the container lids 19 when open. Additionally, the tethers 41 are required to be adjustable so as to accommodate the different distances between the underside of the single outer lid 38 and the various containers 20 with container lids 19 of differing heights. Consequently, the tethers 41 contain holes providing options for the various heights of the containers 20.

Figure 6:
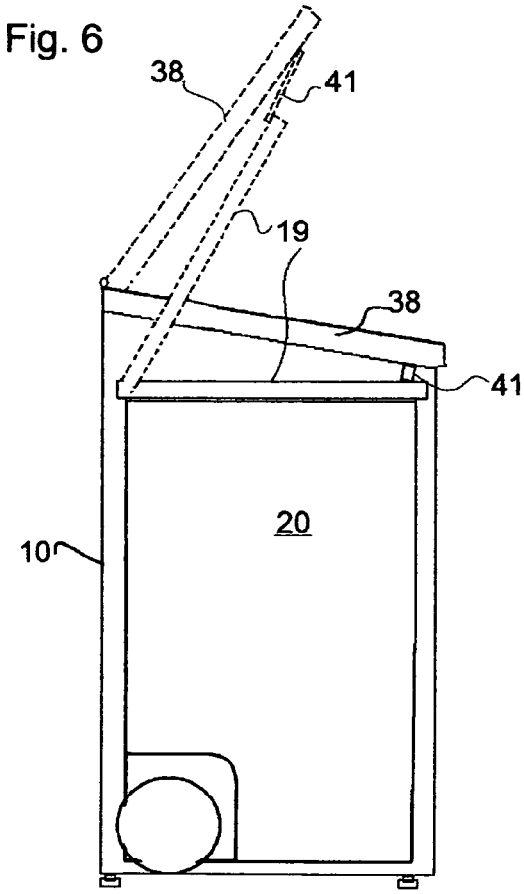
FIG. 6 is a left side sectional elevation view showing the stretched semi-flexible tether in a ghosted line.

FIG. 6 shows a side view demonstrating how the flexible tether 41 stretches when the single outer lid 38 is open, maximizing access to the containers 20.

Referring back to FIG. 4, a first tether mount 43 is secured to each container lid 19 and a second tether mount 42 is secured to the underside of the single outer lid 38. Each tether 41 is attached on one end, to the tether mount to the first tether mount 43, and on the other end to the second tether mount 42, with spring loaded clips 58*a* and 58*b* that have a pivoting spring loaded portion 59*a* and 59*b* that can be manually released to securely couple said tether to said first and second tether mount. The said pivoting spring loaded portion of spring loaded clips 58*a* and 58*b* also being manually movable allowing said tethers to be detached from said first tether mount 43 and or second tether mount 42.

The plurality of tether mounts 42 and 43 are secured to the underside of the single outer lid 38 using fasteners 66, and to the tops of the container lids 19 using a 'high bond' adhesive 60, or other fastening means.

Referring back to FIG. 1, according to the present invention, the user approaches the housing enclosure 10 with various compost, trash and recycling for depositing into various containers 20. The user does not have to place these items on the ground. Rather, the user steps on the pedal 27 and the single outer lid 38 opens, simultaneously opening the container lids 19 of the containers 20 stored inside the housing enclosure 10. The user does not have to touch the containers 20. All of the containers 20 are now accessible as a result of the foot pedal 27 actuation. The user has two free hands available to deposit bags and items into the appropriate containers 20, simultaneously or consecutively. When the user finishes depositing, their foot is withdrawn from the pedal 27, and the spring gas shock 39 allows for a controlled, dampened closing. When the single outer lid 38 is closed the attached container lids 19 are returned to a closed and sealed position.

When the single outer lid 38 is closed, the containers 20 inside the housing enclosure 10 are sheltered from the weather and animals. The downward slope of the single outer lid 38 has the added benefit of deflecting gusts of wind that might otherwise force it open.

On collection day, the containers 20 are easily disconnected from the tethers 41 while the single outer lid 38 remains resting in a closed position. The containers 20 are then rolled out of the housing enclosure 10 to be placed at curbside. Once the containers 20 are returned to the housing enclosure 10 they are pushed back into position and re-attached to the single outer lid 38 for future sorting and depositing.

The optimal materials to construct the described housing enclosure and respective parts required for the present invention will be apparent to those skilled in the art.

The included detailed description is not to be taken in a limiting sense, but is made for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail. The scope of the embodiments should be determined by the appended claims and their legal equivalents, rather than by the examples given.

I claim:

1. A foot pedal operated lid device within a housing enclosure comprising a plurality of containers that each have a set of wheels and a container lid whereby said foot pedal operated lid device operates said plurality of containers and said foot pedal operated lid device comprising:

a single outer lid pivotally connected to said housing enclosure disposed above said plurality of containers;

a foot pedal that is pivotally mounted extends from a front portion of said housing enclosure backwardly coupling to an elongated thrust member that extends upwardly coupling to a single outer lid underside wherein said single outer lid is disposed above said plurality of containers at a height that allows said plurality of containers to be rolled under said single outer lid when it is in a closed position;

each said container lid having a first tether mount centrally attached; said first tether mount detachably coupling to a first spring loaded clip that has a first spring loaded portion that securely couples to an adjustable semi flexible tether that is then detachably coupled to a second spring loaded clip that has a second spring loaded portion which detachably couples to a second tether mount attached to said single outer lid underside in a position that suspends each said container lid beneath the single outer lid when activated by said foot pedal until each said container lid is returned to a closed and sealed position when the foot pedal is released; and further comprising a gas spring shock to assist said foot pedal to urge said single outer lid open.

2. A method of using a foot pedal operated lid device within a housing enclosure comprising a plurality of containers that each have a set of wheels and a container lid whereby said foot pedal operated lid device operates said plurality of containers and said foot pedal operated lid device comprising:

a single outer lid pivotally connected to said housing enclosure disposed above said plurality of containers;

a foot pedal that is pivotally mounted extends from a front portion of said housing enclosure backwardly coupling to an elongated thrust member that extends upwardly coupling to a single outer lid underside wherein said single outer lid is disposed above said plurality of containers at a height that allows said plurality of containers to be rolled under said single outer lid when it is in a closed position;

each said container lid having a first tether mount centrally attached; said first tether mount detachably coupling to a first spring loaded clip that has a first spring loaded portion that securely couples to an adjustable semi flexible tether that is then detachably coupled to a second spring loaded clip that has a second spring loaded portion which detachably couples to a second tether mount attached to said single outer lid underside in a position that suspends each said container lid beneath the single outer lid when activated by said foot pedal until each said container lid is returned to a closed and sealed position when the foot pedal is released; and further comprising a gas spring shock to assist said foot pedal to urge said single outer lid open.

* * * * *